United States Patent [19]

Luther et al.

[11] 3,981,246

[45] Sept. 21, 1976

[54] FIN-STABILIZED SUBCALIBER PROJECTILE

[75] Inventors: Hans Werner Luther, Holzbuttgen; Peter Bender, Dusseldorf, both of Germany

[73] Assignee: Rheinmetall G.m.b.H., Dusseldorf, Germany

[22] Filed: May 2, 1974

[21] Appl. No.: 466,224

[30] Foreign Application Priority Data

May 9, 1973 Germany ..... 2323244

[52] U.S. Cl. ..... 102/93

[51] Int. Cl.[2] ..... F42B 13/16

[58] Field of Search ..... 102/93

[56] References Cited

UNITED STATES PATENTS

| | | | |
|---|---|---|---|
| 3,107,615 | 10/1963 | Brady | 102/93 |
| 3,125,957 | 3/1964 | Lipinski | 102/93 |
| 3,262,391 | 7/1966 | Shober | 102/93 |
| 3,620,167 | 11/1971 | Romer et al. | 102/93 |

*Primary Examiner*—Charles T. Jordan

*Attorney, Agent, or Firm*—Ernest G. Montague; Karl F. Ross; Herbert Dubno

[57] ABSTRACT

A fin-stabilized subcaliber projectile having a drive cage comprising a plurality of segments and surrounding the body of the projectile in its central region. A tail disc is fastened to the cage and jointly covers the segments and tears in the region of the joints upon the release of the cage. Both the tail disc and a plurality of reinforcing segments corresponding to the drive-cage segments, and a connecting piece produces the connection to a burnable cartridge case disposed at the tail end of the drive cage one behind the other, these elements being connected to the drive cage by means of non-burnable fastening means.

3 Claims, 5 Drawing Figures

FIN-STABILIZED SUBCALIBER PROJECTILE

Figure 4:
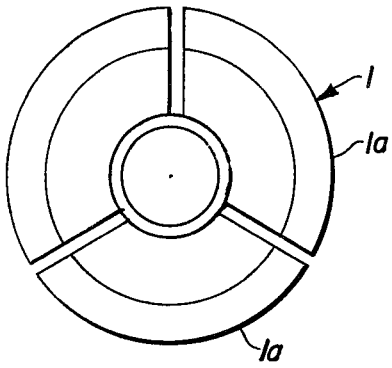

The present invention relates to a fin-stabilized subcaliber projectile having a drive cage, consisting of several segments, which surrounds the body of the projectile in its central region and to which there is fastened a tail disc which jointly covers the segments and tears off in its region of the joints upon the release of the cage.

The fin-stabilized subcaliber projectiles having a drive cage consisting of segment, it is a problem to connect a burnable cartridge case firmly with the projectile. Another problem is to cause the tail disc to break up along the joints of the segments upon the release of the drive cage from the projectile so that the segments can be freed simultaneously and uniformly from the projectile.

The object of the present invention is to improve the arrangement of the burnable cartridge case in a fin-stabilized subcaliber projectile in such a manner that it an be fastened by simple means to the projectile and to the drive cage. Furthermore, a suitable release of the drive-cage segments is to be assured.

In accordance with the invention, this object is achieved in the manner that both the tail disc and a plurality of reinforcing segments corresponding to the drive-cage segments and a connecting piece producing a connection to a burnable cartridge case are arranged one behind the other at the tail of the drive cage and connected to the drive cage by means of non-burnable fastening means.

In accordance with another feature of the invention, the tail disc is provided for the well-defined tearing along respective joints, the regions between joints being backed by reinforcing segments leaving the joints unprotected. The reinforcing segments are so fastened to the burnable connecting piece covering them on the drive cage that after the burning of the connecting piece, the firm connection between the reinforcing segments and the tail disc is retained. Finally, in accordance with another feature of the invention, the reinforcing segments and the connecting piece are connected by fastening screws which are provided with spacer sleeves in such a manner that the base of the latter rest against the reinforcing segment and the collar thereof against the connecting piece.

With this arrangement of the consecutive tail disc, reinforcing sheets and the burnable connecting piece, all of which are firmly connected with the drive cage by fastening screws provided with spacer sleeves, a dependable release of the drive-cage segments is assured.

Figure 1:
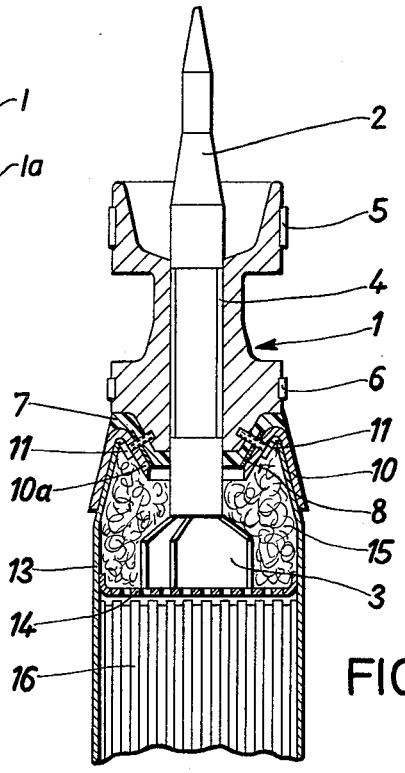
Figure 5:
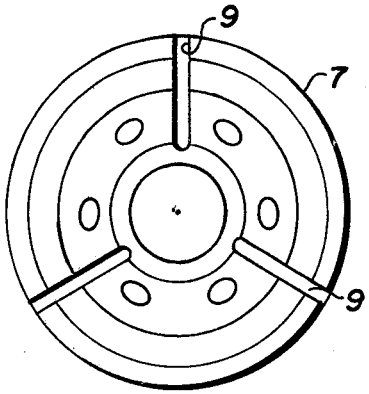
Figure 2:
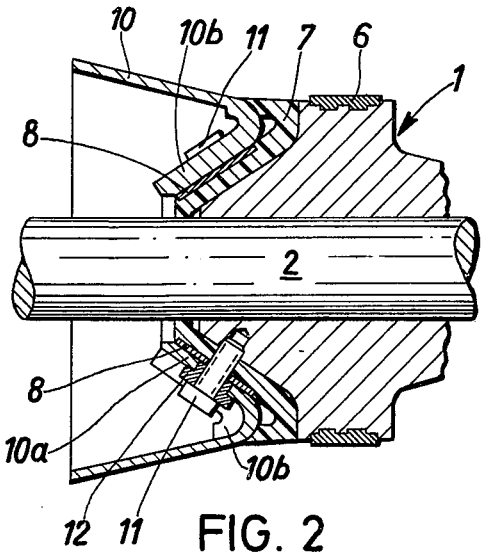
Figure 3:
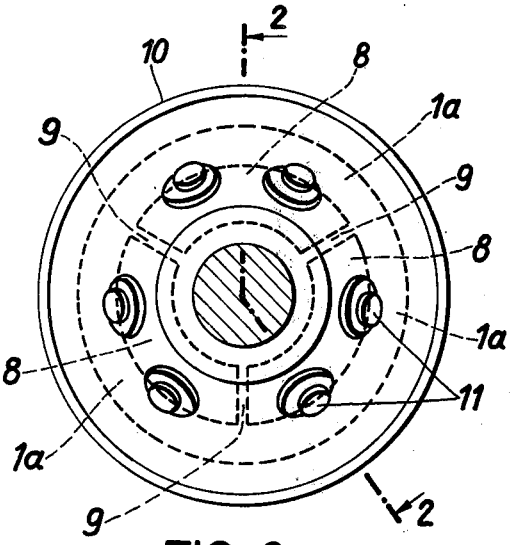

Further details of the invention will be described with reference to an illustrative embodiment shown in the drawing in which:

FIG. 1 shows a fin-stabilized subcaliber projectile together with a cartridge case which is merely indicated, seen in longitudinal section, FIG. 2 is a cross section along the line 2 - 2 of FIG. 3, through the tail side of the drive cage, shown on a larger scale, FIG. 3 is a vertical section through the projectile, looking at the tail side of the drive cage, and FIGS. 4 and 5 are end views of the drive cage and the tail disk, respectively.

The drive cage 1 is divided in known manner into at least two, and preferably three or more, segments 1a. These segments 1a, as long as the projectile 2 provided with a tail vent 3 is in the barrel, are connected by thread or grooves 4 in form-locked manner in the axial direction with the projectile 2. The segments are held together from the outside by the bands 5 and 6. The bands at the same time also assume the guidance of the drive cage 1 in the barrel. To the rear conical end of the drive cage 1 a tail disc 7 is attached by cementing, injecting or other means, said disc acting as a sealing disk taking up the gas pressure, but preventing traces of gas from forcing their way between the joints of the drive-cage segments.

Against the tail disc 7 rest three reinforcing segments 8 which thus, cover the greatest part of the tail disc 7 but leave the joints 9 themselves unprotected. In this way there are produced a total of three intended regions of breakage 9 which extend along the joints on both sides thereof. Adapted to the conicity of the tail disc 7, the inward drawn flange 10a of the connecting piece 10 rests against the reinforcing segments 8. The flange 10a provided with reinforcing ribs 10b has bore holes which can be passed through by the two fastening screws 11 per segment 1a, with their spacer sleeves 12 placed thereon.

While the bases of the spacer sleeve 12 rest firmly against the reinforcing segments 8, the collars of the spacer sleeves 12 hold the flange 10a of the connecting piece 10 firmly. The spacer sleeve 12 is pressed by the head of the fastening screw 11 upon the tightening thereof increasingly more firmly against the sheet 8 and the flange 10a. The actual cartridge case 13, which consists of burnable material in the same way as the connecting piece 10, is glued against the inside of the funnel-shaped connecting piece 10. The inside of said cartridge case space which also surrounds the guide mechanism 3 of the projectile 2 and which is closed off by a cartridge lid 14 is filled with a granulated propellent charge powder 15, while bundled barrel powder 16 is arranged in the large cylindrical space of the cartridge case 13.

The manner of operation is as follows:

After the detonation of the primer cap arranged in the head (not shown) of the cartridge case 13 and of the transfer charge, the barrel powder 16 and the granulated propellent charge powder 15 are ignited one after the other, the cartridge case 13 and the connecting piece 10 together with the flange **10*a* burning simultaneously without residue. In the meantime, a gas pressure has built up behind the drive cage 1 and places the projectile in movement. The spacer sleeves 12 hold the reinforcing segments 8 still pressed firmly against the tail disc 7, while there is no longer any holding function for the collar of the spacer sleeves 12 as a result of the burning off of the flange 10*a***.

As soon as the drive cage 1 has left the muzzle, powder gases rapidly move up approximately to the point of the projectile 2 or even beyond same. The projectile 2 with the drive cage 1 is therefore flowed around from the rear. However, the drive cage 1 is still not released from the projectile, which only commences when the front part of the drive cage 1 is again in a uniform flow coming from in front.

The release, which is favored by the large trough-shaped recess of the drive cage 1, is effected by the spreading open of the segments **1*a*, from the front. The segments 1*a* are still held together at the rear by the tail disc 7 and the rear band 5, while they have already moved away at the front from the projectile 2. After reaching a given angular position, the band 5 and the tail disk 7 tear precisely at the intended regions of breakage 9, so that with the exact tearing of the tail disc 7, there is assured the prerequisite for a simultaneous and uniform release of the segments 1***a* from the projectile 2. Under these conditions, the predetermined trajectory of the projectile 2 up to the target can be precisely maintained.

Of course, within the scope of the invention, the arrangement of the tail disc 7, the reinforcing segments 8 and the connecting piece 10 can also be different if, for instance, the tail of the drive cage 1 extends perpendicular to the longitudinal axis of the projectile.

All features and data disclosed in the papers, and in particular the spatial development and structural development disclosed, are claimed as essential to the invention insofar as they are new, alone or in combination, as compared with the prior art.

We claim:

1. A fin-stabilized subcaliber projectile having a drive cage comprising a plurality of segments surrounding the body of said projectile in a central region thereof, a tail disc fastened to said cage and jointly covering said segments, said disc having joints and tearing in the region of the joints upon the release of said cage, a plurality of reinforcing segments corresponding to said drive-cage segments and defining said joints between them, a burnable cartridge case, and at least one connecting piece connecting said burnable cartridge case, said reinforcing segments and said disk to the tail of said drive cage after the other and by means of non-burnable fastening means.

2. The fin-stabilized subcaliber projectile, as set forth in claim 1, wherein said tail disc is provided with corresponding regions of intended breakage by backing of the disc with said reinforcing segments leaving the joints unprotected, said reinforcing segments being so fastened with a burnable connecting piece covering them at said drive cage, that after the burning-away of said connecting piece, a firm connection remains between said reinforcing segments and said tail disc.

3. The fin-stabilized subcaliber projectile, as set forth in claim 1, wherein said reinforcing segments and said connecting piece are connected to said drive cage by means of fastening screws, the latter being provided with spacer sleeves with bottoms resting against said reinforcing segments, and collars resting against said connecting piece.

* * * * *